United States Patent [19]

Tesch

[11] 4,150,184

[45] Apr. 17, 1979

[54] TEAR-OFF BAND

[75] Inventor: Günter H. Tesch, Fribourg, Switzerland

[73] Assignee: Breveteam S.A., Fribourg, Switzerland

[21] Appl. No.: 868,892

[22] Filed: Jan. 12, 1978

Related U.S. Application Data

[63] Continuation of Ser. No. 726,616, Sep. 27, 1976, abandoned.

[30] Foreign Application Priority Data

Sep. 26, 1975 [CH] Switzerland ..... 12555/75
Sep. 26, 1975 [CH] Switzerland ..... 12556/75

[51] Int. Cl.[2] ..... B65D 65/28

[52] U.S. Cl. ..... 428/43; 156/178; 156/229; 264/288; 428/114; 428/192; 428/294; 428/295; 428/910

[58] Field of Search ..... 428/138, 43, 114, 294, 428/295, 313, 910, 320, 192, 131, 134, 136; 156/77, 176, 178, 229; 264/288

[56] References Cited

U.S. PATENT DOCUMENTS

| | | | |
|---|---|---|---|
| 2,767,113 | 10/1956 | Bower | 428/114 |
| 3,475,264 | 10/1969 | Donaldson | 428/114 |
| 3,697,636 | 10/1972 | Skorozewski | 428/910 |
| 3,969,472 | 7/1976 | Drescoll | 428/910 |

FOREIGN PATENT DOCUMENTS

| | | | |
|---|---|---|---|
| 1174772 | 12/1969 | United Kingdom | 428/910 |

*Primary Examiner*—James J. Bell
*Attorney, Agent, or Firm*—Arthur Schwartz

[57] ABSTRACT

This invention relates to a binding material comprising a longitudinally stretched oriented thermoplastic polymer having the same cross-sectional dimensions all along the longitudinal extensions thereof wherein the stretch ratio is between 5:1 and 8:1. This binding material is useful in tying of rods, wires, plant stems, etc. and it is also useful as bag closures.

16 Claims, 4 Drawing Figures

TEAR-OFF BAND

This is a continuation of application Ser. No. 726,616, filed Sept. 27, 1976 and now abandoned.

BACKGROUND OF THE INVENTION

1. Field of the Invention:

This invention pertains generally to binding materials. More particularly, the present invention relates to a means for the strapping, binding, or bundling of articles.

2. Description of the Prior Art:

Known binding materials include a wide variety of natural and synthetic compositions which are used alone or in combination with each other. These binding materials are used in the form of strings, straps, strips, wires, tapes, tubes, bands, and sheets. The choice of form and/or of material is predicated on the size, dimension and nature of the article to be bound. For example,, binding materials used for bag closure generally are manufactured from strips of formable sheet material, such as paper, thermoplastic high polymers, fabrics or the like and are adhesively bonded in matching relation to form a two-ply band and containing a wire strand. These binding materials or bag closures have gained wide acceptance. Such a binding material made from sheets of polyethylene-imgregnated paper and suitably bonded together is disclosed and described in U.S. Pat. No. 3,068,135. Binding materials having a thermoplastic poylmer, such as polyvinyl chloride covering a wire strand are shown and disclosed in U.S. Pat. Nos. 2,767,113 and 3,409,194. The binding materials of the type described in the aforementioned patents receive their strength exclusively from the inserted wires. The paper and thermoplastic covering surrounding the wires serve only to improve handling and prevent damage to the wall of the bag or the bundled fragile articles, such as plant stems, etc. by the wire. However, this type of binding material has a glaring detect in that the wire strand breaks frequently at the bending point and most often upon a twisting operation. Such breaking of the wire results in the complete failure of the binding material since the paper or the extruded plastic covering does not have the mechanical strength to hold together the bundled article or bag. Therefore, a need exists for a high strength covering for wire strands used as binding materials which would have sufficient mechanical strength to maintain binding ability despite failure of the wire strand.

Additionally, binding materials made of thermoplastic high polymers such as polyethylene, polystyrene, polypropylene, and nylon, have also been used as tapes or bands for unitizing packages. These are generally used without reinforcing elements or stiffening elements such as wire strands. The manufacture of the conventional package tapes generally is performed by extruding and, thus, is highly oriented by longitudinally stretching the film. However, these too possess certain disadvantages. For instance, the prior art non-metallic tapes or bands often produce objectionable tears or splits and have a tendency to fibrilate with the resultant loss of mechanical strength properties. Therefore, the need also exists to improve the properties of binding materials to provide a high tensile strength, and high resistance to transversal tear along with providing a low resistance to longitudinal tear while maintaining the cohesion of the film adjacent to the tear.

SUMMARY OF THE INVENTION

In accordance with this invention it has been determined that a binding material comprising a web or sheet element having a tear characteristic such that a marginal tear having a direction parallel to the stretching direction will continue parallel to the stretching direction while maintaining the cohesion of the film section adjacent to said tear comprising at least one monoaxially stretched film of a partially crystalline thermoplastic polymer wherein the film is stretched longitudinally and the stretch ratio is between 5:1 and 8:1. In another embodiment of this invention the thermoplastic polymer film is reinforced by stiffening elements consisting of rigid non-elastic material which elements are arranged parallel to the longitudinal direction of the stretch and which are adhesively secured to the film. In a further embodiment of this invention the thermoplastic polymer film is foamed before stretch orienting. And yet is still another embodiment of this invention, the thermoplastic polymer film comprises a blend of a partially crystalline thermoplastic polymer and an amorphous thermoplastic polymer which is not completely compatible with the partially crystalline polymer.

It is therefore an object of the present invention to provide a binding material which overcomes objectionable tears or splits in the longitudinal direction of the tape and has a high resistance to tear in the transversal direction of the tape while maintaining the cohesion of the film section adjacent to the tear.

It is also an object of this invention to provide a binding material which can be divided up in portions of desired length and width.

It is still amother object of this invention to provide a binding material having metal stiffening elements embedded in the longitudinally stretched thermoplastic polymer wherein the thermoplastic polymer has a considerable tensile strength providing additional support to the metal stiffening elements, as well as maintaining binding ability and the resistance to tearing in the event of failure of the metal stiffening elements.

It is yet a further object of this invention to provide a variable process for the manfacture of monoaxially stretched film useful as a binding material.

Other and further objects, features and advantages of this invention will become apparent as the description of the preferred embodiments when taken in conjunction with the appended figures of drawing proceeds.

DETAILED DESCRIPTION OF THE INVENTION

Figure 1:
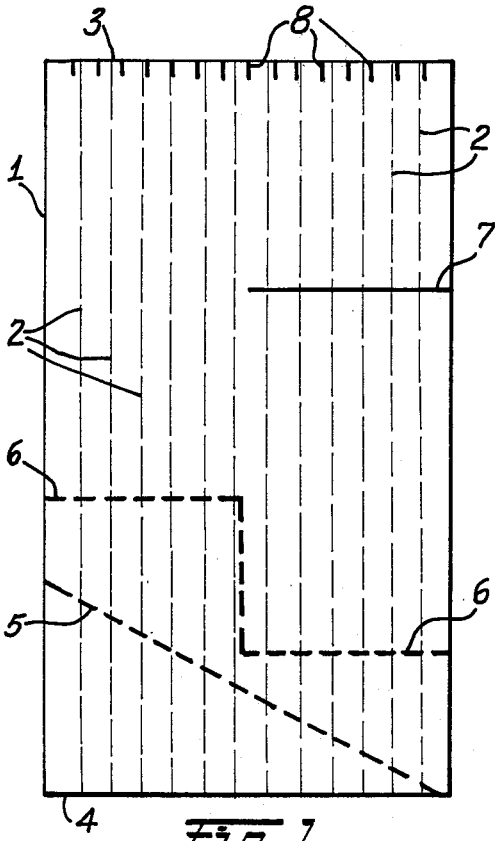
FIG. 1 is a top sectonal view of a portion of a sheet or web comprising monoaxially oriented thermoplastic polymer showing a flat or tape-like binding material in accordance with the present invention.

In order to more fully demonstrate the objects and advantages of the present invention, the following detailed description will be given in terms of the preferred embodiments thereof the same being intended as illistrative and in no wise limitative. In FIG. 1, which shows an embodiment of the present invention, a thermoplastic polymer in the form of sheet 1 is provided. Sheet 1 is cut from a length of film monoaxially stretched in the longitudinal direction which direction is depicted in FIG. 1 as running parallel to lines 2. At least one of the bounding edges 3 of the sheet is cut approximately at right angles to the direction of stretching. The opposite edge 4 may be cut parallel to the edge 3. An obliquely cut edge according to the line 5 or a stepped offset edge according to the line 6 allows the separation of strips having different lengths. It is also possible to provide sheet 1 on one longitudinal wide with an incision 7. Thus, strips of three different lengths can be separated off. For example, long strips from the edge 3 to the edge 4, short strips from the edge 3 to the incision 7, and intermediate length strips from the edge 4 to the incision 7. The binding material of this invention can also be provided as a tape wound on a roll. In this case, it is left to the user to cut off strips of any desired length.

Likewise, the edges 3 and/or 4 can also be provided with a plurality of incisions 8. These facilitate the tearing of the desired width. Certain thermoplastic polymer films monoaxially stretched in accordance with this invention yield very high tensile strength characteristics in the stretching or longitudinal direction and very low resistance to the transverse force. These characteristics provide a material of superior strength properties along with comparative ease to split without complete fibrilation. Thus, when a strip is torn, the tear runs from the edge 3 almost parallel to the lines 2. The sheet 1 can also be provided with grooves which in the drawing approximately coincide with the lines 2 and which facilitate the tearing of the strips. The strips which can be torn off in this way have a substantially cross-section approximately constant over their entire length. The wider strip has correspondingly also a higher tear strength than a narrow strip. Wide strips of several centimeters may be easily twisted by hand to form a round strand. In this way they can be conveniently tied. One application for this embodiment is, for example, for binding a tree trunk to a pole. In order to avoid cutting the trunk of the tree the strip is placed flat around the trunk and is only twisted at the ends for the knotting.

Figure 2:
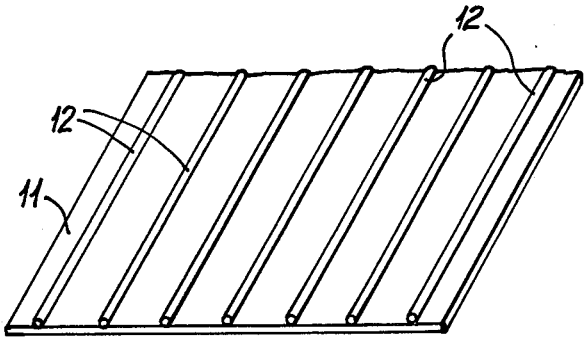
FIG. 2 is a perspective view of stiffening elements embedded parallel to the stretching direction of the monoaxially oriented thermoplastic polymer sheet or web in accordance with an alternate embodiment of the present invention.
Figure 3:
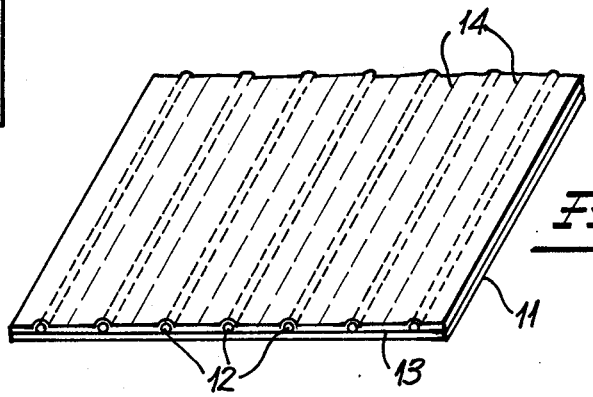
FIG. 3 is a perspective view in which the stiffening elements are metal wires which are held on the sheet by an adhesive and which are made separable by score lines in accordance with an alternate embodiment of the present invention.

In alternate embodiments of the invention according to FIGS. 2 and 3, sheet 11 consists of a monoaxially oriented thermoplastic film stretched longitudinally. The longitudinal stretching direction runs parallel to the stiffening elements 12. The stiffening elements 12 in the embodiment according to FIGS. 2 and 3 can consist of metal wires or suitable organic or inorganic fibers and filaments such as rayon, nylon, polyesters, polyethers, glass, etc. The latter are fixed on the sheet 11 by means of an adhesive. As the sheet 11 consists of a bonding material which is capable of splitting apart in longitudinal direction, it is possible to draw-off from the sheet 11 strips of any desired width which may have one, two or several wires 12 and which run correspondingly parallel to the wires 12. The strips can be cut to any length desired. Advantageously, the sheet 11 can be cut to a suitable size so that it has a certain supply of strips of a predetermined length. The separation of the strips may be facilitated also by the application of grooved or scoring lines to sheet 11 which run between and parallel with the wires 12.

The embodiment according to FIG. 3 differs from that according to FIG. 2 in that the wires 12 are firmly held on the sheet 11 by an adhesive coating 13. Generally, adhesive coatings based on thermoplastic resins which are non-tacky at room temperature, can be deposited in the liquid state and which have the ability to form an adhesive bond with the thermoplastic material of sheet 11 are suitable. Adhesives of various types can be employed in forming the laminate. A suitable adhesive composition for this purpose is Surlyn (Registered Trade Mark of the Du Pont de Nemours & Co. (Inc.), which is an ionomerized resin comprised of a particular ethylene copolymer. If the deposition of the adhesive coating is thick it may be necessary to apply grooves or score lines between the wires 12. These grooves or score lines may be a plurality of perforations passing through the coating 13 longitudinally disposed along the sheet 11, the perforations comprising rows of slits parallel to the longitudinal axis of the sheet 11.

Figure 4:
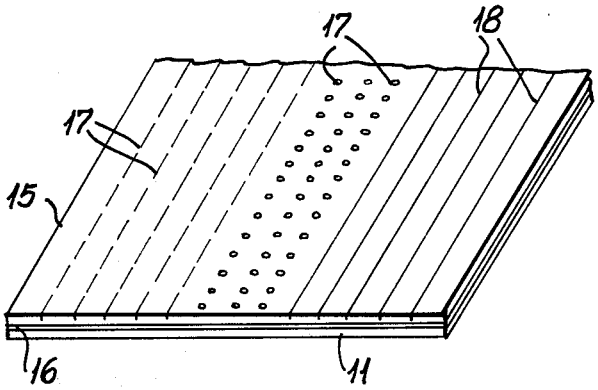
FIG. 4 is a perspective view in which the stiffening element consists of metal strips which are held on the sheet by an adhesive and which are separated by score lines in accordance with an alternate embodiment of the present invention.

In still another embodiment as shown in FIG. 4, the stiffening elements consist of metal strips 15 which adhere to the sheet 11 by means of an adhesive coating 16. Advantageously, the strips 15 are formed from an oblique flat metal foil which can be provided before the application to sheet 11 with score lines 17 or which can be grooved and fluted after uniting with the sheet 11.

Thermoplastic polymers which may be used in the practice of this invention include the high molecular weight (i.e., above about 45,000) solid polymers exhibiting a crystalline X-ray diffraction pattern. Polyolefin polymers such as polypropylene and polyethylene may be employed. Polypropylene is preferred. Among the other solid polymers which may be employed are polyesters, polycarbonates, polyamides, acrylic resins and many of the other film forming thermoplastic polymer materials. Mixtures of partially crystalline polymers containing from 5 to 15% of amorphous polymer are most suitable. This mixing of the partially crystalline polymer with the slightly incompatible amorphous polymer results in a superior tear characteristic in the monoaxially longitudinal direction. Thus, mixtures of polyporpylene and polystyrene are most preferred for use as binding materials.

In the prior art monoaxially oriented film is achieved by longitudinal stretching for the manufacture of filaments and fibers, however, conventional stretching ratios for these purposes exceed 12:1 and are generally much higher. Surprisingly, it has been found according to this invention that the maximum characteristic benefits for binding materials are attained by a stretching ratio from 5:1 and 8:1. The term "stretching ratio" is the ratio of the total stretching length to the initial length. The longitidinal stretching is preferably carried out in two stages. Within this range the optimization of a stretching ratio for a given thermoplastic polymer composition can easily be determined visually. If, for example, the stretching ratio is too high, a fibrous network is forced and a tear will yield fribrilation or the formation of distinct separated fibers. If the stretch ratio is too low longitudinal tearing forms a tough skin between the edges of the tears which can be detected by visual inspection. The tears which are adjacent to each other render subsequent tearing impossible. The stretching ratio is optimized when a marginal tear having a direction parallel to the stretching direction will be continued parallel to the stretching direction while maintaining the cohesion of the film section adjacent to the tear. Under those conditions the tearing of the strips of constant desirable widths is accomplished with minimum effort.

The construction of cohesive strips of constant width through simple separation of the sheet is advantageously provided by suitable choice of components of the sheet material. This can occur in various ways by undertaking measures which reduce the cohesive strength transverse to the molecular network structure in the desired manner. One embodiment of this invention includes the application of a foaming agent which is mixed with the plastic granules in the extrusion of sheet and which is foamed before the stretching operation.

In another embodiment according to this invention an amorphous polymer which is incompatible with a partially crystalline polymer can be admixed therewith in small quantities. Mixtures of thermoplastic polymers containing between 5 to 15 parts by weight of the amorphous polymer to 100 parts by weight of the partially crystalline polymer are suitable.

And still another embodiment according to this invention is the application of a foaming agent into the above-described blend of partially crystalline-amorphous thermoplastic polymer before longitudinal stretching to provide a foamed binding material.

The binding materials according to this invention incorporate strengthening agents which include metals which upon bending have small spring-back elasticity and suitable organic or inorganic fibers and filaments, for example, polycarbonates, polyesters, such as polyethylene terephthalate, or polyamides, such as nylon, cellulosic polymers such as rayon, inorganic materials like glass fibers, etc.

The binding material may be coated or printed on one or both sides provided the coating does not prevent the prescribed tearing of the strips.

The utility of binding materials of this invention is directed to the strapping, binding or bundling of various articles. The following are examples of the use of the material which are not to be considered as limiting: binding of plants, tying of flowers, binding of harvested crops, stringing of packets, and as bag closures.

The invention will be further illustrated by the following example which relates to the use of a blend of a polypropylene and polystyrene.

EXAMPLE

A film from a mixture of 100 parts by weight of polypropylene (Novolen 13:0 HX of BASF AG, D-Ludwigshafen) 7 parts by weight of polystyrene and 3 parts of weight of a queen masterbatch is mixed.

The mixture is then processed through a film blowing installation with an inflation ratio of 5:1 and is longitudinally drawn to a stretch ratio of 5:1 to a film tube. The film is then stretched again in a ratio of 8:1. The film thickness is 0.05 mm. Tearing of strips in the longitudinal direction from this film or sheet is effortless without fibrilation, i.e., complete splitting of the fiber network. On the other hand the transversal strength of this film is greatly increased. For example, a film strip of 5 mm width cannot be torn by hand across the transverse direction.

It will be obvious to those skilled in the art that any modification may be made within the scope of the present invention without departing from the spirit thereof, and the invention, therefore, includes all such modifications.

What is claimed is:

1. A binding material comprising a polymeric sheet element capable of severance into a binding strip of variable, selective width and strength by a tearing operation, said sheet comprising a monoaxilly stretched film of a polymer including at least a major proportion of a partially crystalline thermoplastic polymer, which film has been subjected to a fibrillation preventing-effective stretching operation within the range of stretch ratios of from about 5:1 to about 8:1 to impart a tearing characteristic thereto, such that successive initial tears in a marginal area thereof having a direction parallel to the longitudinal stretching direction will continue substantially parallel thereto while cohesion of the film section adjacent said tears is maintained, whereby said sheet may be torn into parallel binding strips of individual, variable, selective widths corresponding to the distances separating said initial tears.

2. The binding material according to claim 1, wherein said sheet is foamed before longitudinal stretching.

3. The binding material according to claim 1, wherein said polymer is a polymer blend comprising between 5 and 15 parts by weight of an amorphous thermoplastic polymer and 100 parts of a partially crystalline thermoplastic polymer.

4. The binding material according to claim 3, wherein the partially crystalline polymer is polypropylene and the amorphous polymer is polystyrene.

5. The binding material according to claim 1, wherein said sheet is reinforced by strengthening elements which elements are arranged parallel to the stretch direction and which are adhesively bonded to said sheet.

6. The binding material according to claim 5, wherein the strengthening elements include rigid non-elastic material.

7. The binding material according to claim 6, wherein said rigid non-elastic material is a metal.

8. The binding material according to claim 7, wherein said rigid non-elastic material are metal wires.

9. The binding material according to claim 5, wherein said strengthening elements are organic or inorganic fibers and filaments.

10. The binding material according to claim 9, wherein said organic or inorganic fibers and filaments are selected from the group consisting of polycarbonates, polyesters, polyamides, cellulosic polymers and glass fibers.

11. The binding material according to claim 7, wherein the strengthening elements consist of a metal coating on said thermoplastic sheet divided into strips by means of score lines or incisions running parallel to the direction of the longitudinal stretching.

12. The binding material according to claim 1, wherein said thermoplastic sheet is provided with grooves running parallel to the direction of longitudinal stretching.

13. The binding material according of claim 1 having a plurality of marginal tears in the longitudinal direction which can be cut transversally to said longitudinal direction at a predetermined length.

14. A binding material according to claim 1, wherein said sheet is partially coated.

15. A binding material according to claim 1, wherein said thermoplastic polymer is polypropylene.

16. A method of binding comprising the step of tearing a binding strip of variable, selective width and strength from a polymeric sheet comprising a monoaxially stretched film of a polymer including at least a major proportion of a partially crystalline thermoplastic polymer, which film has been subjected to a fibrillation preventing-effective stretching operation within the range of stretch ratios of from about 5:1 to about 8:1 to impart a tearing characteristic thereto, such that successive initial tears in a marginal area thereof having a direction parallel to the longitudinal stretching direction will continue substantially parallel thereto while cohesion of the film section adjacent said tears is maintained, whereby said sheet may be torn into parallel binding strips of individual, variable, selective widths corresponding to the distances separating said initial tears.

* * * * *